US009775441B2

(12) United States Patent
Burrill

(10) Patent No.: US 9,775,441 B2
(45) Date of Patent: Oct. 3, 2017

(54) SHEET TIGHTENING SYSTEM

(71) Applicant: Jeffrey Burrill, Plymouth, MN (US)

(72) Inventor: Jeffrey Burrill, Plymouth, MN (US)

( * ) Notice: Subject to any disclaimer, the term of this patent is extended or adjusted under 35 U.S.C. 154(b) by 0 days.

(21) Appl. No.: 14/979,405

(22) Filed: Dec. 27, 2015

(65) Prior Publication Data

US 2017/0251819 A1 Sep. 7, 2017

Related U.S. Application Data

(60) Provisional application No. 62/097,161, filed on Dec. 29, 2014.

(51) Int. Cl.
*A47C 21/02* (2006.01)

(52) U.S. Cl.
CPC ..... *A47C 21/022* (2013.01)

(58) Field of Classification Search
CPC ..... A47C 21/02
USPC ..... 5/498, 504.1, 659; 24/72.5
See application file for complete search history.

(56) References Cited

U.S. PATENT DOCUMENTS 2,507,097 A * 5/1950 Fields ..... B67B 7/92 241/99
4,967,430 A * 11/1990 Merkel ..... A47C 21/022 24/72.5
8,918,931 B1 * 12/2014 Baker ..... A47C 21/003 5/482

* cited by examiner

*Primary Examiner* — Fredrick Conley
(74) *Attorney, Agent, or Firm* — Skaar Ulbrich Macari, P.A.

(57) ABSTRACT

A system and method for tightening and removing slack in a fitted or flat sheet and to secure the sheet to prevent the slack from returning.

10 Claims, 6 Drawing Sheets

SHEET TIGHTENING SYSTEM

CLAIM OF BENEFIT TO PRIOR APPLICATIONS

This application claims the benefit of U.S. Provisional Application No. 62/097,161 filed Dec. 29, 2014; and such application is hereby fully incorporated by reference herein.

FIELD

The present invention relates generally to bedding and sheets and a system for holding a fitted or flat (unfitted, non-elasticized) bed sheet securely to the mattress in order to minimize sheet movement during sleep to maximize sleep comfort.

BACKGROUND

A known problem in the field of bedding is sheets being moved about, or even becoming completely separated from the bed, by body movement during sleep. Such movement can lead to sleep disruption or discomfort by way of bunching up of a loosened bottom sheet under the body, and other problems, such as direct exposure of the mattress to sweat when a loose bottom sheet is dislodged from beneath a sleeper. Fitted bed sheets, in particular, are manufactured to be used on a variety of mattress sizes that may vary somewhat in height, width and length. So too, a fitted bed sheet might vary slightly from its intended dimensions. As a result, the fitted bed sheet may have an excess amount of sheet slack that causes the fitted sheet to fit loosely on the mattress. Additionally, a flat bed sheet may be used to cover a mattress. The natural movement of a sleeping person can result in the bunching of the sheets and such an uneven surface can make it difficult to achieve a restful night sleep. Prior solutions to such bedding displacement issues have been proposed, including use of straps to secure or tie-down the fitted bottom sheet to the mattress to better resist movement thereof, and combining of a top sheet and fitted bottom sheet into a single unit to reduce top sheet movement by anchoring of the top sheet and fitted sheet together and onto the mattress. Examples of strap arrangements for securing bedding in place include those disclosed in U.S. Pat. Nos. 4,891,856, 6,161,235, 3,092,848, 4,040,133, 6,233,764 and U.S. Patent Application Publications 2009/0172881, 2009/0241261 and 2012/0060285. Elastic straps and bands are difficult to install due to the heavy weight of the mattress and may require two people to install; one person to lift the mattress while the other person stretches the straps or bands in place under the mattress. The elastic straps and bands often stretch too much and are unable to keep the sheet in place and tight to the mattress. Further, the clamps of the elastic straps or bands sometimes can slip off the sheet and damage the sheet. When tube-like clips with length-wise opening are used there are often problems with the installation process as wrapping the sheet around the pencil-sized seam of the mattress and covering the seam and sheet with the clip can be a difficult process. For at least these reasons there is a need for an improved sheet tightener that solves the problems above described.

SUMMARY

The invention provides a bed sheet securing system that is comprised of a pair of rollers and bases. One roller and base pair are used to stabilize each side of the fitted or flat bed sheet by rolling sheet slack into the roller, locking the roller into the base and securing the roller and base between the mattress and box spring. Alternatively, the roller with the rolled-up bed sheet may be pushed between the mattress and box spring, and the base is pushed into place underneath the roller and bed sheet, thereby locking it in place between the mattress and box spring. Moreover, more than one set of the bed sheet securing system may be used to achieve the desired degree or location of tightness on the mattress. As an example, the securing system may be used on both the side of the mattress and from top to bottom (or head to toe) to achieve bed sheet tightness in both directions.

The above summary is not intended to limit the scope of the invention, or describe each embodiment, implementation, feature or advantage of the invention.

DETAILED DESCRIPTION

FIGS. 1-6 depict various views of a preferred embodiment of the invention. The sheet tightening system 50 comprises roller 100 and base 200 used in combination when the user wants to stabilize and tighten a fitted or flat bed sheet on the mattress. The roller 100 and base 200 are paired together, each roller and base set used to stabilize one side of the bed sheet.

Figure 4:
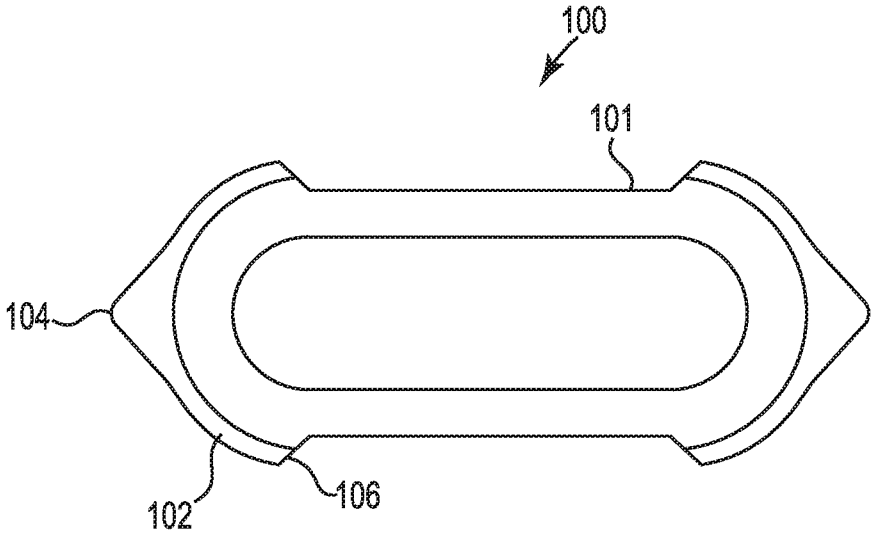
FIG. 4 is a side elevation view of the roller thereof.
Figure 5:
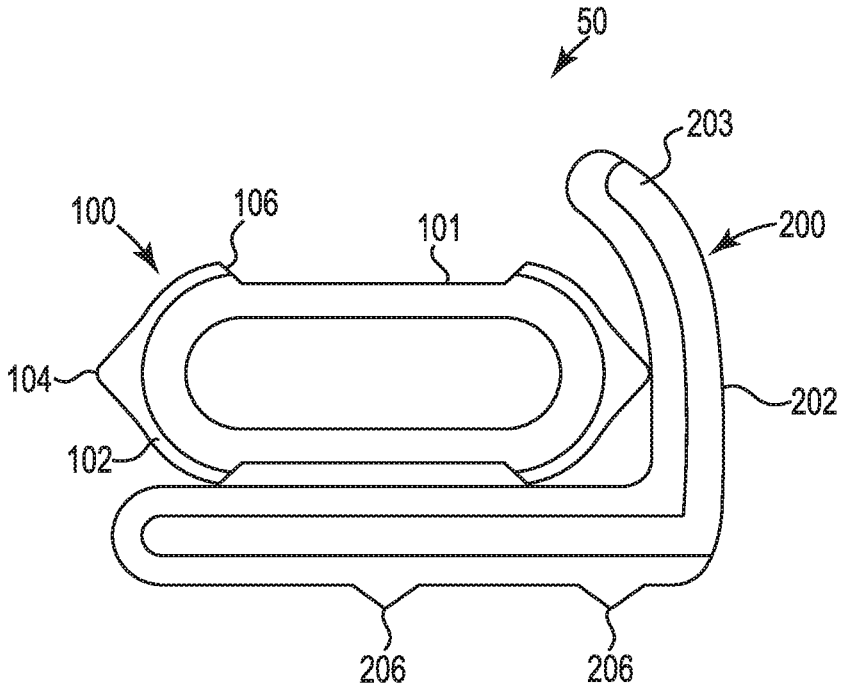
FIG. 5 is a side elevation view of the roller engaged with the base.

Sheet tightening system 50 includes roller 100 and base 200. Roller 100 preferably consists of a stadium shaped substructure 101 and integrated caps 102. The stadium shaped profile of the substructure can be best seen in FIG. 4. Integrated caps 102 are located on the outer surface of each side of substructure 101. Caps 102 have narrowed end portions 104 which point generally outwardly, and preferably lie on the longitudinal axis of substructure 101, as can be seen in FIGS. 4 and 5. Ridges 106 are preferably formed where integrated caps 102 terminate on to substructure 101. Substructure 101 can be hollow for ease of manufacturing, and is preferably made from strong materials, such as rigid PVC, for strength and durability. Caps 102, including narrowed end portions 104 and ridge portions 106, are preferably made from softer PVC or other material that will have a high coefficient of friction when in contact with typical bedsheet materials to promote secure engagement with the bed sheet, to prevent the bed sheet from slipping off roller 100.

Figure 1:
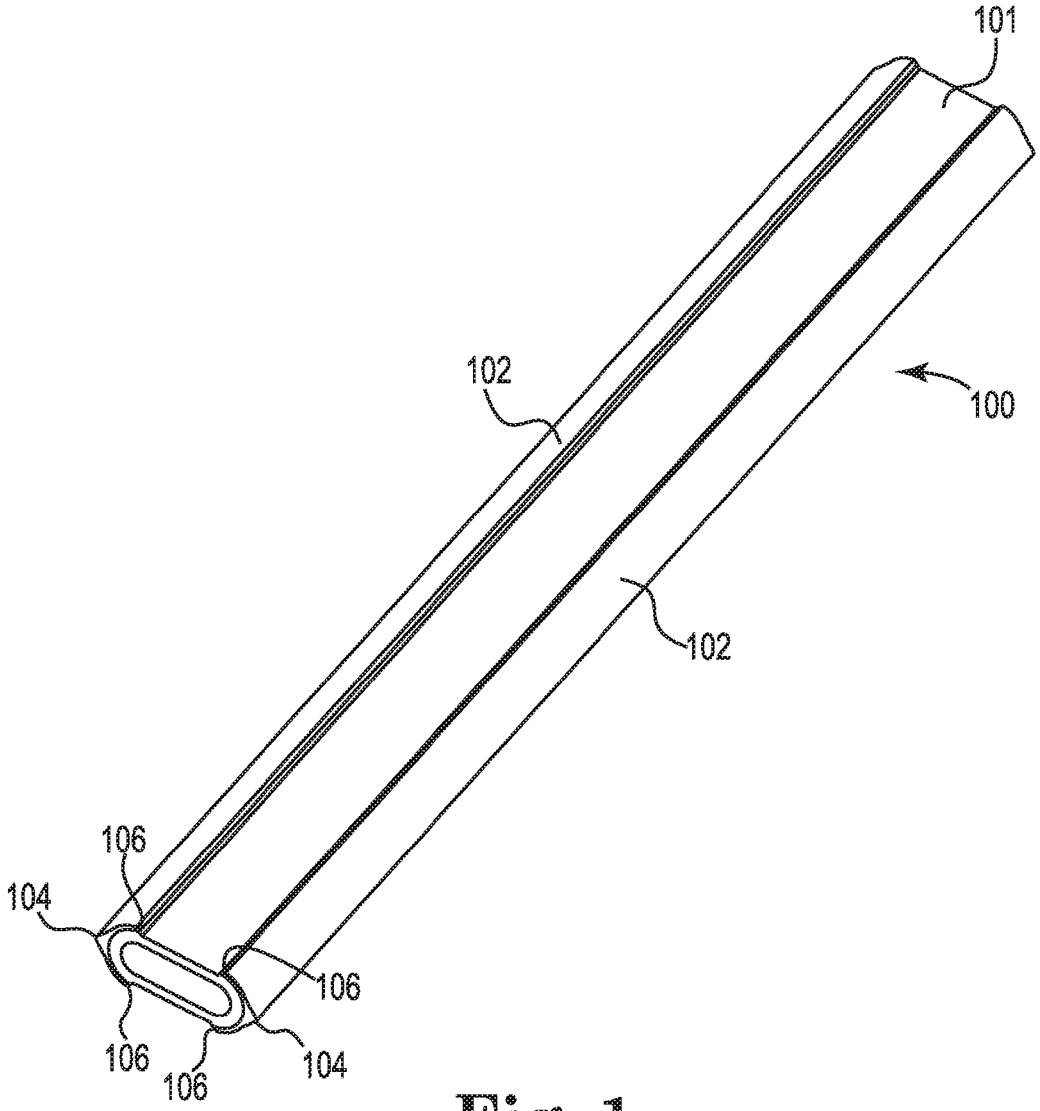
FIG. 1 is a perspective view of the roller of the present invention.
Figure 2:
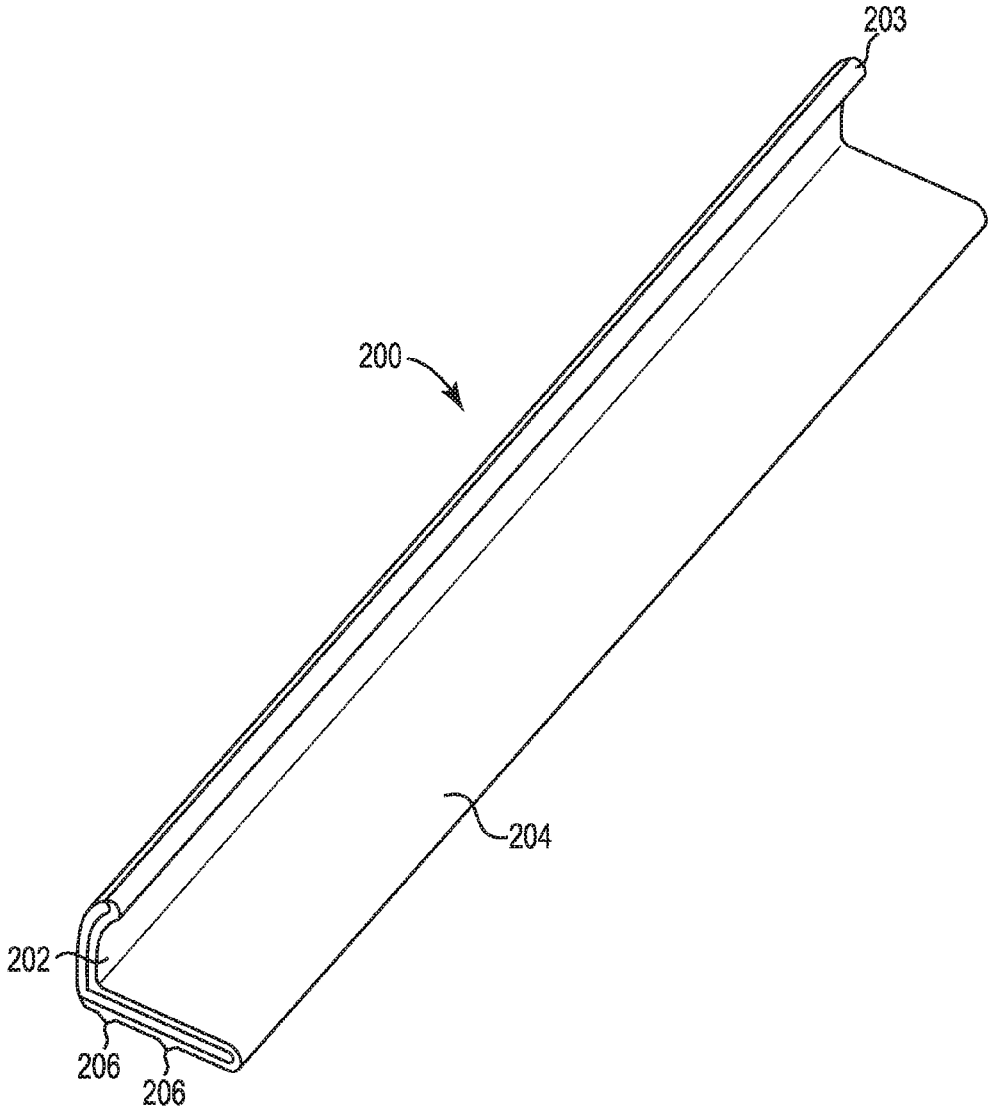
FIG. 2 is a perspective view of the base thereof.
Figure 3:
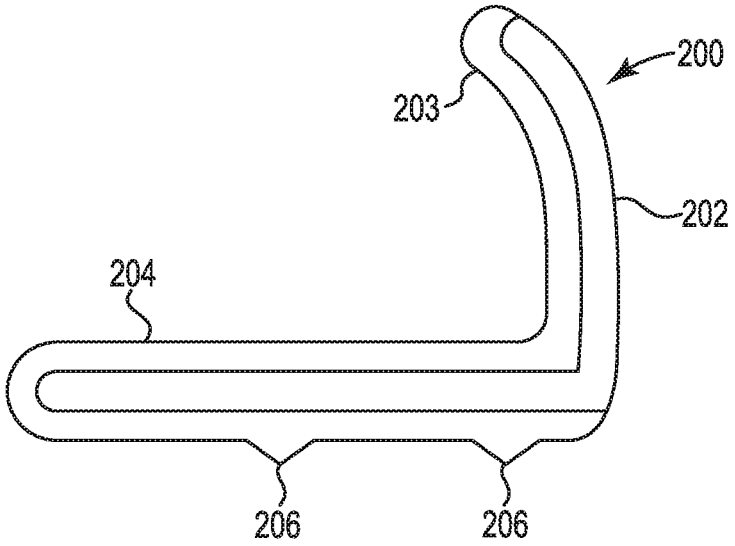
FIG. 3 is a side elevation view of the base thereof.
Figure 6:
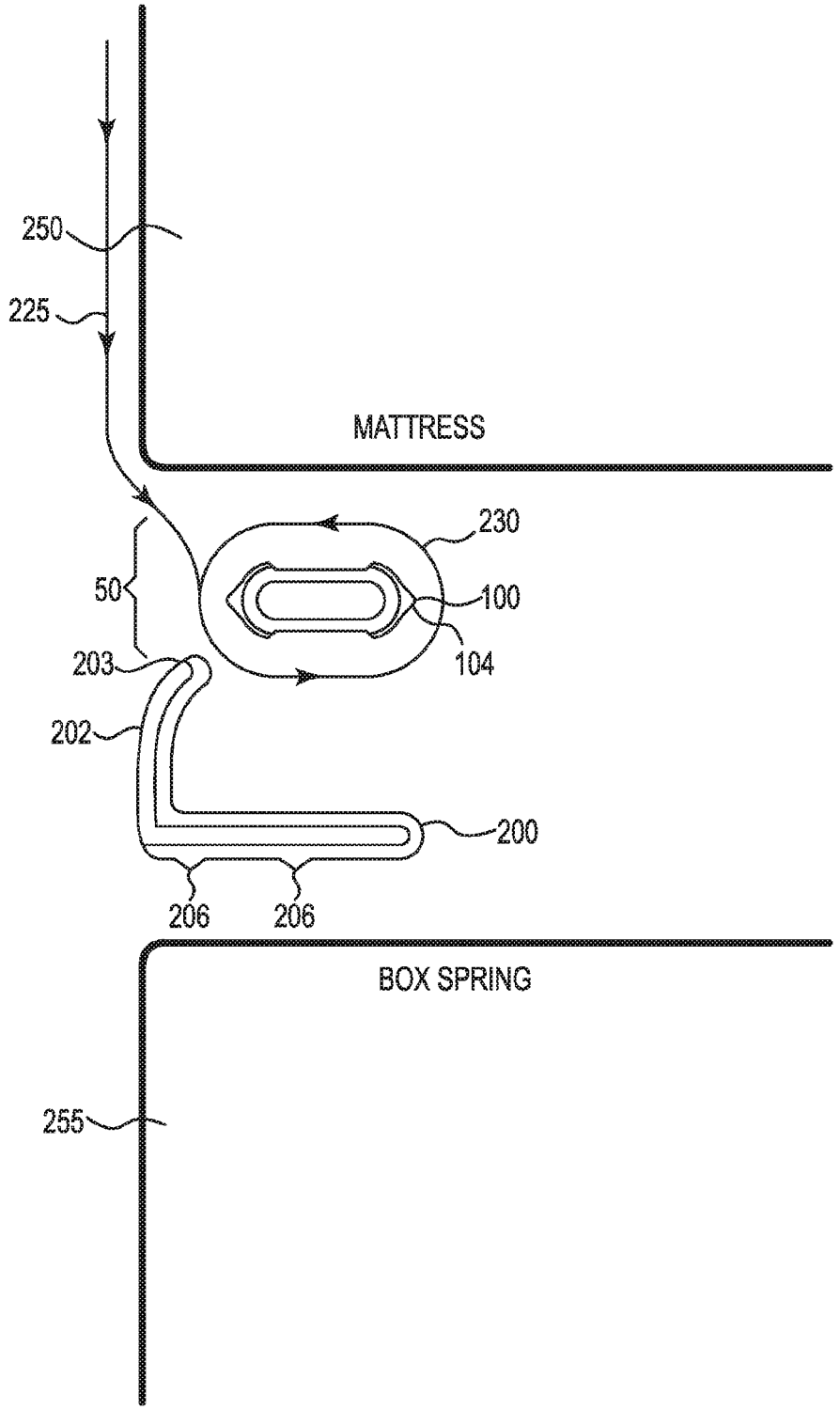
FIG. 6 is a view of the roller and base in use.

As seen in FIG. 3, Base 200 comprises a generally L-shaped structure. The generally vertical portion 202 of generally L-shaped base 200 includes curved portion 203 that extends back over the horizontal portion 204 and the more vertical portion 202. The more vertical portion of 202 is preferably constructed of strong materials, such as rigid PVC, for strength and durability. The more curved portion of 202, portion 203, is preferably made from softer PVC or other material that will have a high coefficient of friction when in contact with typical bedsheet or mattress materials. Ridges 206 are also preferably constructed from softer PVC, or the like, for the same reasons. These attributes of L-shaped structure 200 contribute to the mechanical locking effect of sheet tightening system 50 by allowing the compression of the mattress weight to hold the sheet tightening system 50 in place, to promote secure engagement with the bed sheet, when rolled on roller 100, to prevent the bed sheet from slipping on base 200. As best seen in FIGS. 5 and 6, the more vertical portion of 202 and curved portion 203 are a preferred construction to secure roller 100 of system 50 in base 200 and prevents roller 100 from rolling out over the top when under the tension of a bed sheet.

The horizontal portion 204 of base 200 is preferably slightly greater in length than the vertical portion 202 of L-shaped base 200. So, for example, if vertical portion 202 measures approximately one and one half inches in height, the horizontal portion 204 would preferably be made 2 inches in width. These are preferred dimensions. Having the horizontal portion slightly longer than the vertical portion increases the stability of base 200, and when roller 100 is engaged with base 200 under the tension of the bed sheet, the base resists tilting which assists in preventing roller 100 from slipping out of base 200 or over portion 203, and releasing the tension on the bed sheet.

As best can be seen in FIGS. 3 and 5, the bottom of the horizontal portion of base 200 incorporates one or more ridges 206. Ridges 206 are intended to engage a box spring or the like when system 50 is in use. This construction assists in preventing base 200 from becoming dislodged when the base 200 is under tension from the bed sheet wrapped in roller 100, and engaged in base 200.

FIG. 6 illustrates a portion of sheet tightening system 50 in use. Thus for example, if the slack in sheet 225 to be removed exists in the area of the hips of the bed's occupant, roller 100 is first placed on one side of the bed adjacent to that position. Roller 100 is placed on the inside of sheet 225 with the pointed side 104 of the roller 100 placed near the elastic for a fitted sheet, or the end of the sheet for a flat or non-fitted sheet. Sheet 225 is then rolled inward tightly around roller 100 two or three rotations so the sheet will securely engage roller 100 and resist slipping off. Roller 100, with sheet 225 engaged is then pulled down until the desired tightness of sheet 225 on the mattress 250 is achieved. Sheet tightening system 50 is most effective when there exists 2 or more inches of slack in the area of the bed sheet to be secured. Roller 100, with sheet 225 engaged thereon, is then pushed under the mattress, and between the mattress and box spring 255, if present. Base 200 is then place securely up against the portion 230 of sheet 225 rolled up on roller 100, to lock the roller in place. Ridges 206 are placed to engage box spring 255 or other surface under the mattress, to insure roller 100 and base 200 remain in place. It is preferred that the locked roller and base be placed under mattress 250 at least one inch from the edge of the mattress so that the weight of mattress 250 can assist in holding roller 100 and base 200 in place. The same procedure is then followed on the opposite side of the mattress, in the same location across from the first installed roller and base, to complete the installation.

It is preferable that each base 200 and roller 100 be approximately nine inches in length. A slightly longer base and roller is contemplated under more extreme conditions dependent on the size of the mattress and the size of the occupant of the bed. It is preferable, however, if the mattress size or size of the occupant requires additional bed sheet tightening, that additional tightening roller and base pairs be used as required to remove the desired amount of sheet slack.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. For example, the dimensions and proportions indicated in the figures may be altered without departing from the scope of the invention.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A bed sheet tightening system comprising:

an elongated L-shaped base having a length; a vertical member that has a height, a top edge, and is generally curved; a horizontal member that is generally flat, the horizontal member having a width, a length, a top surface, and a bottom surface that incorporates at least two downwardly protruding ridges; wherein the curve of the vertical member extends the top edge over at least a portion of the horizontal member top surface;

an elongated roller having a length, a width and a height; a substructure that has a stadium shaped profile, the substructure having two parallel flat sections integrated with two curved sections that connect the two flat sections;

two cap members, each cap member being generally integrated with the substructure and centered on a longitudinal axis of the stadium shaped profile, each cap member having a narrowed tip portion, the narrowed tip portions pointing generally away from the substructure; and, wherein the length of the base is generally the same as the length of the roller; the height of the vertical member of the base is less than the width of the horizontal member of the base; the height of the roller is less than the height of the vertical member of the base; and, the width of the roller is generally the same as the width of the horizontal member of the base.

2. The system of claim 1 wherein the length of the roller is approximately nine (9) inches.

3. The system of claim 1 wherein the caps terminate on the flat sections of the substructure, and a ridge is formed at each point of termination.

4. The system of claim 3 wherein the ridge is constructed of soft PVC material.

5. The system of claim 1 wherein the narrowed tip portions, the downwardly protruding ridges and the top edge of the vertical member of the base are constructed of soft PVC material.

6. A sheet tightening system comprising:

an elongated L-shaped base having a length; a horizontal section of the L-shaped having a top surface and a bottom surface, the bottom surface having two downwardly protruding gripping portions; a vertical section of the of the L-shaped base having a top ridge configured to frictionally engage a mattress surface;

an elongated roller having a generally stadium shaped profile, having a first and a second curved end, a length that is generally the same length as the elongated base;

the curved ends are narrowed and configured to grip a sheet rolled around the rollers; and, wherein the base is sized such that, when a sheet is rolled onto the roller, the roller can be securely placed into the base such that the vertical section of the L-shape resists the roller exiting the base.

7. The system of claim 6 wherein the length of the roller is greater than 8 inches but less than 14 inches.

8. The system of claim 6 wherein the vertical section of the base is curved such that the center of curvature lies on the horizontal section side of the base.

9. A bed sheet tightening kit comprising:

two elongated L-shaped bases, each having a length; a horizontal section having a bottom surface incorporating two downwardly protruding gripping portions; a vertical section having a top ridge configured to frictionally engage a mattress bottom surface;

two elongated rollers each having a generally stadium shaped profile, each having a first and a second curved end, each having a length that is generally the same length as each elongated base; and each roller having curved ends that are narrowed and configured to frictionally grip a sheet rolled around each of the rollers; and, wherein each base is sized such that, when a sheet is rolled onto each roller, each roller can be securely placed into one base such that the vertical section of each base resists each roller exiting each base.

10. The kit of claim 9 wherein the length of each base greater than 8 inches but less than 14 inches.

* * * * *